United States Patent [19]

Groddeck

[11] Patent Number: 4,909,216

[45] Date of Patent: Mar. 20, 1990

[54] REGULATING ARRANGEMENT OF A FUEL-INJECTION PUMP WITH A LEVER

[75] Inventor: Michael Groddeck, Mechenbeuren, Fed. Rep. of Germany

[73] Assignee: MTU Friedrichshafen GmbH, Fed. Rep. of Germany

[21] Appl. No.: 236,351

[22] PCT Filed: Aug. 17, 1987

[86] PCT No.: PCT/DE87/00365

§ 371 Date: Jul. 6, 1988

§ 102(e) Date: Jul. 6, 1988

[87] PCT Pub. No.: WO88/04360

PCT Pub. Date: Jun. 16, 1988

[30] Foreign Application Priority Data

Dec. 12, 1986 [DE] Fed. Rep. of Germany ..... 3642458

[51] Int. Cl.[4] ..... F02M 39/00

[52] U.S. Cl. ..... 123/386; 123/373; 123/385; 123/372

[58] Field of Search ..... 123/359, 385, 386, 387, 123/372, 373

[56] References Cited

U.S. PATENT DOCUMENTS

| | | | |
|---|---|---|---|
| 2,142,172 | 1/1939 | Brill | 123/386 |
| 2,185,147 | 12/1939 | Edwards | 123/387 |
| 2,280,496 | 4/1942 | Meiswinkel | 123/387 |
| 2,445,321 | 7/1948 | Fox | 123/387 |
| 3,859,973 | 1/1975 | Dreisin | 123/386 |
| 3,916,862 | 11/1975 | Clouse | 123/386 |
| 4,380,223 | 4/1983 | Jefferson | 123/387 |
| 4,640,247 | 2/1987 | Bruning | 123/386 |

FOREIGN PATENT DOCUMENTS

| | | | |
|---|---|---|---|
| 3402934 | 8/1985 | Fed. Rep. of Germany | 123/386 |

*Primary Examiner*—Carl Stuart Miller

*Attorney, Agent, or Firm*—Barnes & Thornburg

[57] ABSTRACT

The lever (13) cooperates on the one hand with a rotatable part (12) and, on the other, is coupled with a to-and-fro movable adjusting member (14). The lever (13) consists of a housing (15) traversed by the rotatable part (12), of a piston-like spring plate (16) and of a return spring (19) clamped-in between housing (15) and spring plate (16). Spring plate (16) and rotatable part (12) form in the mutually cooperating area a torque-limiting driving device. The hollow space (25) underneath the spring plate (16) is adapted to be acted upon with oil pressure by bores (21, 22) in the rotatable part (12) which are controllably connected to a pressure oil source (24). The oil pressure displaces the spring plate (16) so that the driving device is disengaged. The lever (13) is then displaced by the spring (27) of the to-and-fro movable part into an end position independently of the position of the rotatable part (12) which corresponds to the zero delivery of the fuel injection pump (11).

8 Claims, 1 Drawing Sheet

REGULATING ARRANGEMENT OF A FUEL-INJECTION PUMP WITH A LEVER

Figure 1:
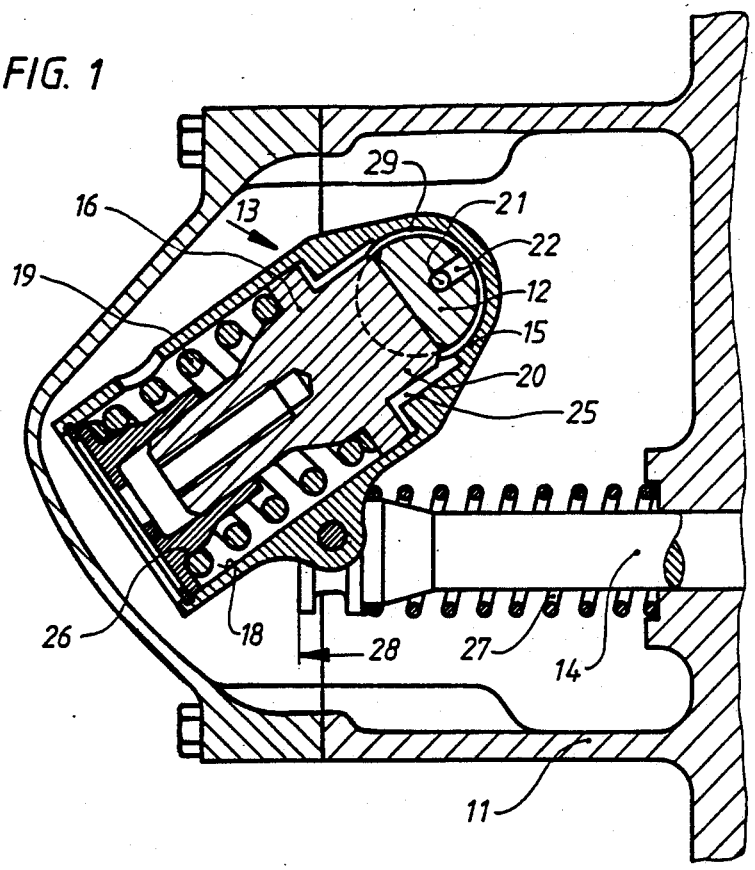

The invention relates to a regulating arrangement of a fuel-injection pump with a lever. The blocking of the regulating device by a jamming pump piston in one of the coupled fuel-injection pumps is prevented by the torque-limiting driving device between rotatable part and lever. The other fuel-injection pumps ready for operation can therefore be continued to be regulated so that the internal combustion engine in question remains limitedly operational.

Regulating arrangements of this type are known from the DE-PS No. 564 169 and the DE-OS No. 34 06 646. Furthermore, it is known from the DE-PS No. 29 50 633 to move the to-and-fro movable adjusting member of a fuel-injection pump into an end position by an axial force independently of the position of the lever which end position corresponds to the zero delivery of the pump piston. The stopping of the to-and-fro movable adjusting member changes the position of the lever independently of the instantaneous position of the rotatable part. As a result thereof, the driving device is displaced from its off-position against the force of the return spring. The restoring moment then resulting at the lever acts by way of the rotatable part on the regulator of the internal combustion engine coupled with the regulating arrangement and reduces the operating capability of the regulator in an undesired manner.

The sum of the torques which, during the stopping of adjusting members can act back on the regulator, must not exceed the operating capability of the regulator as otherwise the internal combustion engine is no longer operational. A maximum permissive prestress force for the return spring in the lever results therefrom for given conditions of a regulating arrangement. With known arrangements, the permissive prestress force of the return spring is so small that during operation of the internal combustion engine, it may lead to strong vibrations at the levers and in the entire regulating arrangement which leads to friction wear especially at the driving devices.

It is the task of the invention to create a regulating arrangement, by means of which the to-and-fro movable adjusting member of a fuel injection pump can be brought remotely actuated into a zero delivery position without resulting in a reduction of the operating capability of the regulator.

This task is solved according to the invention with the characterizing features of the claims. By opening the controllable valve pressure oil reaches by way of the bearing gap between housing and rotatable part the driving device side of the spring plate which is lifted thereby and renders the driving device inoperable. The lever is therewith freely pivotal within limits without load by the return spring. The to-and-fro movable adjusting member spring-loaded in the direction of the end position for zero delivery of the pump piston is therewith in the position to assume under entrainment of the coupled lever the zero delivery end position unimpaired by the position of the rotatable part.

The advantages achieved with the invention consist in particular in that the arrangement can be assembled in a simple manner, in that the arrangement has a small space requirement, in that the decoupling between lever and rotatable part operates without feedback on the connected regulator, in that the return spring of the lever can be dimensioned without limitation by the regulator operating capacity and in that vibrations of the regulating arrangement and of the friction wear resulting therefrom are avoided with a greater spring prestress of the return spring.

Figure 2:
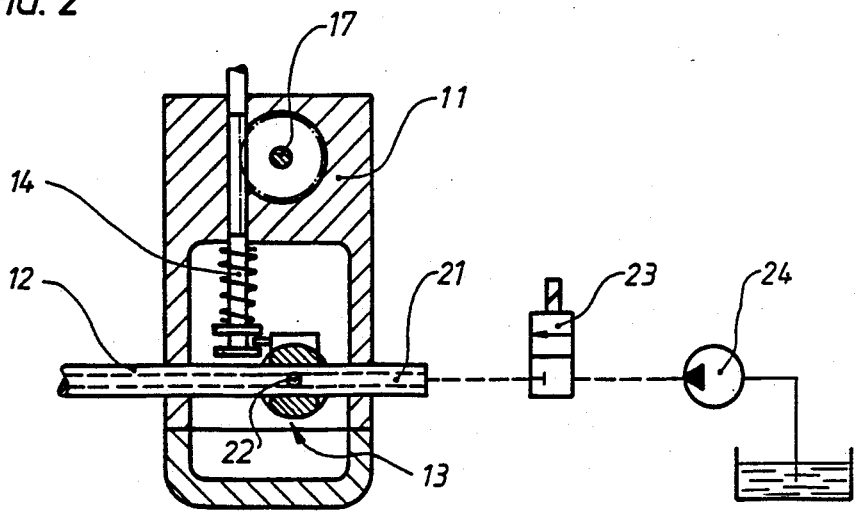

One embodiment of the invention is illustrated in the drawing and will be described more fully hereinafter. It shows:

FIG. 1 cross section of a fuel injection pump within the area of the lever;

FIG. 2 schematic partial illustration of the regulating arrangement.

A regulating arrangement for the adjustment of the feed quantity of a fuel injection pump 11 consists of a regulator not illustrated, of a rotatable part 12 connected with the regulator, of a lever 13 cooperating with the rotatable part 12 and of a to-and-fro movable adjusting member 14 coupled with the lever 13.

The piston 17 of the fuel injection pump 11 is adjusted in a known manner to different feed quantities by the adjusting member 14.

The lever 13 consists of a housing 15 which includes a slide-bearing-like cross bore 29 for the accommodation of the rotatable part 12, of a piston-like spring plate 16 which is arranged in a cylinder bore 18 of the housing 15 and of a return spring 19 clamped-in between housing 15 and spring plate 16.

The spring plate 16 includes on the side facing the rotatable part 12 a prismatic extension 20 which abuts with its end face at a secant-like flat of the rotatable part 12 under prestress by the return spring 19. Spring plate 16 and rotatable part 12 form within the mutually cooperating area a torque-limiting driving device.

The rotatable part 12 includes an axially parallel bore 21 which is connected by way of a controllable valve 23 with a pressure oil source 24, for example, with the lubricating oil system of an internal combustion engine.

Within the area of the driving device, a bore 22 branches off radially from the bore 21, which terminates inside of the housing 15 in the bearing gap, which is illustrated enlarged in FIG. 1, between cross bore 29 and rotatable part 12.

As soon as the bore 21 is acted upon with pressurized oil, the pressurized oil reaches by way of the bearing gap the hollow space 25 between spring plate 16 and rotatable part 12. Owing to the pressure building up in the hollow space, the spring plate 16 is lifted up to the abutment 26. The connection between the prismatic extension 20 of the spring plate 16 and of the secant-like flat of the rotatable part 12 is cancelled thereby and the torque transmission of the driving device is thereby interrupted. The spring 27 of the to-and-fro movable adjusting member 14 now presses the lever 13, independently of the position of the rotatable part 12, into the zero delivery end position indicated by 28.

Further fuel injection pumps not illustrated here, which are regulated by way of the rotatable part 12 and which include a bore 22 in their lever 13, are shiftable to zero delivery end position remotely controlled by the pressure oil piston actuation. The fuel supply is therewith interrupted in the cylinders coordinated to these fuel injection pumps of an internal combustion engine.

The hydraulic disengagement of the driving device prevents the occurrence of a restoring moment on the rotatable part 12 so that no reduction of the regulator operating capability occurs as a result of disengaged fuel injection pumps.

I claim:

1. A regulating arrangement of a fuel-injection pump, comprising:

a rotatable part, an angular position of which regulates a feed quantity of the fuel-injection pump, the rotatable part being provided with a bore extending substantially parallel to an axis thereof, a radial bore branching off from said axially parallel bore also being provided within the rotatable part, adjusting means for adjusting the feed quantity of the fuel-injection pump in accordance with the angular position of the rotatable part, lever means releasably connected with the rotatable part and connected with the adjusting means for controlling the adjusting means in accordance with the angular position of the rotatable part when the lever means is connected with the rotatable part and for permitting the adjusting means to adjust the feed quantity of the fuel-injection pump independently of the angular position of the rotatable part when the lever means is released from the rotatable part, the lever means including housing means, a piston-like spring plate which engages the rotatable part to fix the lever means to the rotatable part and return spring means clamped-in between the housing means and the spring plate, said branching-off bore terminating inside of the housing means within the area of the spring plate, and controllable valve means operatively connecting the bores with a pressure oil source whereby pressurization of the bores urges the spring plate away from the rotatable part against the return spring and disengages the rotatable part from the lever means.

2. A regulating arrangement according to claim 1, wherein the spring plate and rotatable part form a torque-limiting driving means within the mutually cooperating area.

3. A regulating arrangement according to claim 2, wherein the rotatable part extends through the housing means.

4. A regulating arrangement according to claim 3, wherein the radially branching-off bore is arranged within the area of the means of the rotatable part.

5. A regulating arrangement according to claim 4, wherein the radially branching-off bore terminates inside of the housing means within the area of the driving means side of the spring plate.

6. A regulating arrangement according to claim 1, wherein the radially branching-off bore is arranged within the area of the means of the rotatable part.

7. A regulating arrangement according to claim 1, wherein the radially branching-off bore terminates inside of the housing means within the area of the driving means side of the spring plate.

8. A regulating arrangement according to claim 1, wherein the rotatable part extends through the housing means.

* * * * *